United States Patent [19]

Wartman et al.

[11] 4,287,514

[45] Sep. 1, 1981

[54] MAILBOX ANNOUNCER

[76] Inventors: Carl E. Wartman, 29 Colonial Dr., Cocoa Beach, Fla. 32931; George Dussich, 7007 N. Atlantic Ave., Suite 207, Cape Canaveral, Fla. 32920

[21] Appl. No.: 140,725

[22] Filed: Apr. 16, 1980

[51] Int. Cl.[3] ..... G08B 21/00

[52] U.S. Cl. ..... 340/569; 200/61.63

[58] Field of Search ..... 340/545, 568, 569; 200/61.58 R, 61.63, 61.7, 61.81

[56] References Cited

U.S. PATENT DOCUMENTS

| | | | |
|---|---|---|---|
| 3,611,333 | 10/1971 | Conigliaro | 340/569 |
| 4,101,877 | 7/1978 | Rush | 340/569 |

*Primary Examiner*—Alvin H. Waring

[57] ABSTRACT

A signaling device for being coupled to a mailbox of the type having a cantelievered tongue section defined below the mailbox door hinge. A snap-type single pole single throw (SPST) push on push off action switch is coupled to the base of the mailbox adjacent to the tongue section of the door for generating a first signal responsive to the operative communication between the tongue section of the door as the door is opened. An electrical circuit is coupled to the switch for generating a sensory perceptible signal responsive to receiving the first signal from the switch. The switch is mounted on a generally U-shaped bracket which may be deformable as the switch is being actuated, thereby reducing the possiblity of damage to the switch as the door is opened.

8 Claims, 6 Drawing Figures

MAILBOX ANNOUNCER

BACKGROUND OF THE INVENTION

I. Field of the Invention

The present invention relates to an alarm or signaling system for being attached to mailboxes, and more particularly the invention relates to electrical alarms which are actuated by the opening of the mailbox doors, such as for inserting and removing mail therefrom.

II. Description of the Prior Art

In years past, roadside mailboxes were common both in rural and in newly developing urban areas. More recently the U.S. Postal Service has allowed homeowners to relocate their mailboxes to locations generally adjacent to the front door of the house in order to improve the convenience to the homeowner. Unfortunately, this newer location requires the postal carrier either to walk between the houses or to drive a mail truck along a circuitous route between the houses. Since the U.S. Postal Service is attempting to improve efficiency, the use of pedestrian mail delivery is being discouraged, and in view of the substantially increased prices of petroleum products in recent years the circuitous traveling of postal vehicles should be minimized in delivering the mail.

Several studies are presently being conducted by the U.S. Postal Service and the Department of Energy to re-institute roadside or curbside mailboxes. In this manner the mail may be delivered by the Postal Service in a more efficient manner. That is, the Postal delivery vehicle will merely travel along one side of the road and the mail will be delivered to each business or residence through a curbside/roadside mailbox. The use of these mailboxes in everyday business and household applications requires several adaptations and adjustments. For example, it is anticipated that the theft of important documents, checks and money orders sent through the mail will increase when curbside/roadside mailboxes are again instituted. This increase is predicted because the occupant of the dwelling is usually aware through visual and auditory perception of the delivery of the mail, whereas these visual and auditory perceptions will be substantially reduced when the mailbox is located further from the dwelling. Furthermore, thieves are usually thought to be more reluctant to come into close proximity with a dwelling in order to steal contents of a mailbox attached thereto as compared with the ease of theft from a detached mailbox.

It is therefore an object of the present invention to provide additional visual and/or auditory warnings to the occupant of the dwelling that the U.S. Postal Service has deposited mail into the curbside/roadside mailbox.

The prior art is replete with various types of mailbox alarms. However, as a group these mailbox alarms are quite complicated in their construction and they usually require that the mailbox be originally designed in order to incorporate the sensing mechanism for the alarm. This should be contrasted with the ready availability of the standard curbside/roadside mailbox which can be fitted with a suitable sensor. It is therefore a second object of the present invention to provide a mailbox alarm of the type which can be either incorporated into the mailbox at the time of production, or in the alternative of the type to be coupled to an already existing curbside/roadside mailbox.

One common example of a mailbox alarm of the type which must be incorporated into the mailbox at the time of production, is described by Korth in U.S. Pat. No. 2,477,379. In this device a lip of the lid of the mailbox is forced into communication with switching elements when the lid of the mailbox is opened. However, the switching device is located inside the mailbox which is not of the type readily adaptable to curbside/roadside use.

A second example of an alarm of the type to be attached to mailboxes which are typically attached to the house is described by Whildin in U.S. Pat. Nos. 2,759,057 and 3,040,141. These devices place the switch inside the cavity within the mailbox. The switch is then actuated by a lip affixed to the underneath side of the door closing over the entranceway into the mailbox. This type of alarm system is only suitable for incorporation into mailboxes at the time of production and is not suitable for mailboxes of the type normally located at curbside.

Lang, in U.S. Pat. No. 1,808,235, discloses a mailbox alarm which utilizes the door of the mailbox as one of the electrical elements of the switch. A tongue of the door is moved into electrical contact with another portion of the backside of the mailbox as the entryway door of the mailbox is opened. This switch is immediately deactivated when the door of the mailbox is closed. Alarms and switches of this type are not well suited for normal security applications because if the occupant of the business or household is inadvertently inattentive to the mailbox alarm, the occupant will not have any indication that the mail has been delivered. Thus, this type of impulse or short period alarm is not best suited to the objects of the present invention.

Darvishian, in U.S. Pat. No. 3,935,994, discloses a custom designed mailbox which incorporates an electrical switch which is actuated by a main section of the door which closes over the entryway into the mailbox. Because of the location of the actuating switch, alarm systems of this type are not well suited for retrofit applications into existing curbside/roadside mailboxes. Various other designs of alarm systems of the type more suitable for non-roadside mailboxes are disclosed by Donadio in U.S. Pat. No. 2,480,288, Holmgren, in U.S. Pat. No. 1,911,621, Miller in U.S. Pat. No. 1,157,949, Landrum, in U.S. Pat. No. 1,442,578, Hopkins in U.S. Pat. No. 1,021,100 and Hill in U.S. Pat. No. 3,009,139.

Various mailbox alarm systems have been designed specifically for mailboxes of the type normally located by the side of the road. For example, U.S. Pat. No. 3,707,260 discloses a complex mechanical lever and pivot system which actuates a radio frequency transmitter responsive to the opening of the door covering the entranceway to the storage compartment within the mailbox. Again, this type of complex alarm system is not suitable for easy and economical retrofit applications to existing detached mailboxes.

Tracy, in U.S. Pat. No. 322,665, discloses a mailbox alarm system which locates a sensor switch inside the mailbox and adjacent to a lip of the door for the entryway of the mailbox. This type of sensor switch requires careful placement and alignment within the mailbox, and is therefore not well suited for retrofit applications. U.S. Pat. Nos. 3,606,141 and 918,530 disclose mechanical signal devices which employ flags or other non-electrical signaling devices for indicating that the door to the mailbox has been opened. U.S. Pat. Nos. 1,112,346, 1,019,554 and 1,005,004 disclose electro-mechanical mailbox alarms of the type which may be coupled to curbside/roadside mailboxes. However, these devices again are not suitable for retrofit applications to existing mailboxes of this type. Grindle, in U.S. Pat. No. 1,037,470 discloses a mailbox alarm which senses the weight of the mail deposited within the mailbox in order to actuate the alarm mechanism.

A careful review of the preceding prior art references will clearly indicate that a new approach must be taken to the design of a mailbox alarm system. The alarm actuator must be inexpensive to produce and easily attached to the mailbox in a position which does not require work in confined spaces. The alarm switch sensor must be rugged in order to survive negligent or inattentive abuse, and must survive extended exposure to inclement weather. It is furthermore desirable that the sensor switch not be located within the mailbox so as not to reduce the volume available for storage of the mail therein. It is most important that the switch sensor be easily coupled to pre-existing curbside/roadside mailboxes without the use of complex drilling jigs or other uncommon machinery or tools.

SUMMARY OF THE INVENTION

The present invention relates to a signaling device for being coupled to a mailbox of the type including a generally horizontal base in an upward extending container coupled thereto for defining an entryway and a storage compartment therein. The mailbox also includes a door for closing over the entryway and hinge coupled between the base and the section of the door above the lower edge thereof so as to define a lower cantelievered tongue section of the door which rotates towards the base as the door is opened. Switch means are provided adjacent to a lower surface of the base and adjacent to the tongue section of the door for generating a first signal responsive to operative communications with the tongue section of the door as the door is opened. Electrical signal means are coupled to the switch means for generating a sensory perceptible signal responsive to receiving the first signal. The switch means may include a snap action movable switch which locks into a closed condition upon being first depressed, and which must be released and again depressed in order to revert to an open condition. The switch may be attached to a generally U-shaped deformable bracket which is relatively flexible in order to deform responsive to any additional opening displacement of the door after the switch has been actuated.

BRIEF DESCRIPTION OF THE DRAWINGS

Other objects, features and advantages of the present invention will be apparent from a study of the written description and the drawings in which.

Figure 1:
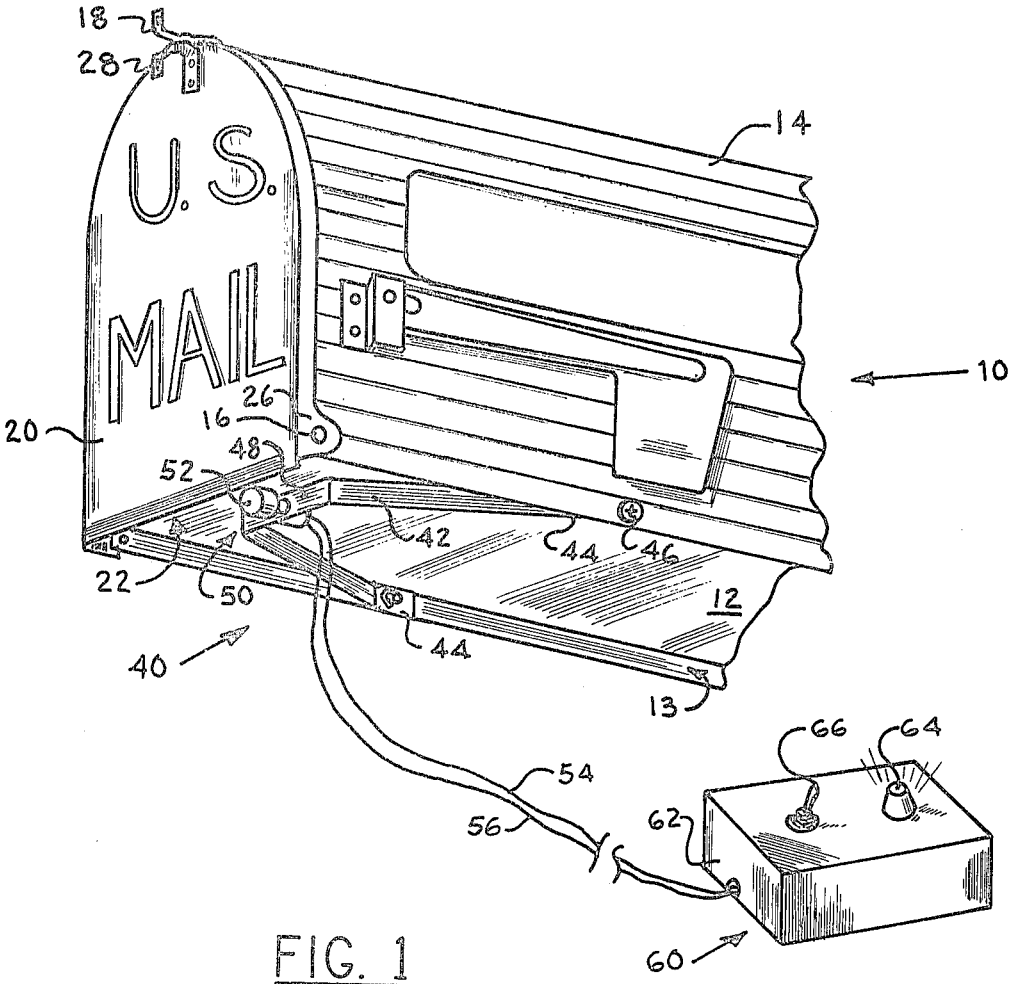
FIG. 1 illustrates a partial side perspective view of a curbside/roadside mailbox having the present alarm system coupled thereto.

In the drawings, like reference characters will refer to like parts throughout the several views of each of the embodiments of the present invention. However, variations and modifications may be effected without departing from the spirit and scope of the concept of the disclosure, and as defined by the appended claims. It should also be observed that the element and operation of the embodiments of the present invention have been illustrated in somewhat simplified form in each of the drawings and in the following specification in order to eliminate unnecessary and complicating details which would be apparent to one skilled in this art. Therefore, other specific forms and constructions of the invention will be equivalent to the embodiments described although departing somewhat from the exact appearance of the drawings.

DETAILED DESCRIPTION OF THE PREFERRED EMBODIMENT

A first preferred embodiment of the present invention is illustrated generally in FIG. 1 as being attached to a commonly available curbside/roadside mailbox. The mailbox, illustrated generally as 10, includes a generally rectangular base 12 having coupled thereto a curved side and top section of a container 14. The sides of the container 14 extend downwardly beyond the base 12 in order to define a rectangular recessed area 13. One end of the mailbox 10 is usually enclosed, while the second end thereof generally defines an entryway into the cavity defined by the base 12 and the container 14.

A movable door, illustrated generally as 20, is movably coupled over the entryway of the mailbox 10 in order to provide an environmental seal in order to exclude rain, dust and other pollutants from the inside of the container. The door 20 includes on either side thereof a pair of ears 26 which movably couple with corresponding pivot hinges 16 attached to the outside surface of the mailbox 10. In this manner the door 20 folds down towards the front and lower section of the mailbox 10. A bottom section of the door 20 extends below the horizontal level of the pivot hinges 16, and thereby defines a tongue or cantelievered section shown generally as 22 in the drawing. This tongue section 22 of the door 20 moves in a rearward direction as the door 20 is opened in order to provide access to the internal section of the mailbox 10. A latch 28 on the door 20 resistively couples with a mating latch 18 attached to the top of the container 14.

It should be noted that the most commonly available curbside/roadside mailboxes 10 include in some form or other the tongue section 22 of the door 20 and the recessed rectangular area 13 below the base 12. It will therefore be obvious to one skilled in this art that various other forms of similarly constructed mailboxes may also be adapted to receive the mailbox alarm as disclosed herein.

The mailbox alarm comprises two generally separate subsystems consisting of a switch or sensing subsystem, shown generally as 40, and a display subsystem shown generally as 60. The switch subsystem includes a mounting bracket 42 which has the form of a "U" or a "V" with the U-shape being slightly preferred. The distended ends 44 of the mounting bracket 42 are each coupled to the depending recessed section 13 of the container 14 immediately below the base 12. The typical curbside/roadside mailbox 10 is manufactured to include the plurality of aperatures within the recessed area 13, and the distended ends 44 of the mounting bracket 42 are sized so as to be fastened to these aperatures by a simple bolt and nut combination 46.

A switch, illustrated generally as 50, is coupled through an aperature within a central or apex section 48 of the mounting bracket 42. The size of the mounting bracket 42 and the switch 50 are predetermined so that the tongue section 22 of the door 20 will couple with and operatively actuate the switch 50 when the door 20 is opened a predetermined distance.

In the first preferred embodiment of the present invention the switch 50 comprises a single pole, single throw (SPST) push on push off switch of the type which latches upon being depressed. That is, if it is assumed that the switch 50 is in the open condition prior to being actuated, then when the switch is actuated the switch changes into the closed condition and latches into the closed condition until it is again depressed and actuated. This switch 50 includes a shock-absorbing button section 52 which is typically manufactured of a soft plastic material in order to reduce friction and absorb the shock as the tongue section 22 of the door 20 is opened. The switch 50 is coupled to a pair of electrical conductors 54 and 56 which generally communicate with the display subsystem 60.

Figure 6:
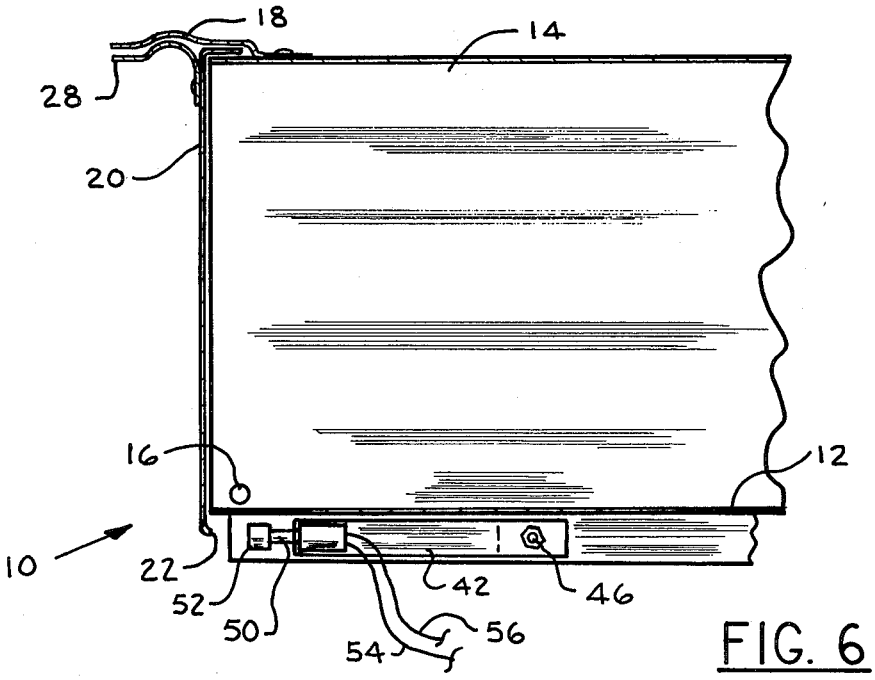
FIG. 6 is a cross section elevation of the first preferred embodiment of the invention as illustrated in FIG. 1.

The display subsystem 60 includes a generally rectangular box 62 having a light or other illumination element 64 and a disable switch 66 attached to the top thereof. A display subsystem 60 is designed to be located within the house or business office with which the mailbox 10 is associated. With reference to the schematic diagram illustrated in FIG. 4, a power transformer 70 is coupled to a source of 110 volt 60 Hertz AC power. While the schematic diagram illustrated in FIG. 6 shows that the alarm system operates on an AC voltage, it will be understood by one skilled in the art that the output of the secondary of the transformer 70 may be rectified in order to operate the system on a DC voltage. The output voltage of the secondary of the transformer 70 is typically a low voltage in order to preclude or minimize shock hazards and ground leakage. The signal light 64 is coupled in series with the disable switch 66, which in turn are coupled in series with the circuit conductor 54 and the main sensing switch 50. The other element of the main sensing switch 50 is coupled by the circuit conductor 56 to the opposite side of the secondary winding of the transformer 70.

In this manner when the disable switch 66 is closed, the subsequent closure of the main sensing switch 50 will complete the circuit in order to enable current to flow through the signal light 64. The illumination of the signal light 64 will indicate to the occupant of the house or business that the door 20 has been opened and the main switch 50 has been actuated. Since the switch 50 contains a locking mechanism, the signal light 64 will remain illuminated until the door 20 is again opened. In this manner if the occupant of the house or business is not home or is inattentive at the time the mail is delivered, a subsequent inspection of the signal light 64 will indicate that the mail has been delivered at an earlier time. When the occupant proceeds to retrieve the mail by opening the door 20 of the mailbox 10, the switch 50 will again be actuated and the signal light 64 will be disabled. The disable switch 66 is provided when the occupant of the house or business intends to be away for several days and does not wish the mailbox alarm to be continuously actuated for that period of time. Since the occupant would not be available to retrieve the mail, no purpose would be served by actuating the switch and illumination device each time the mail was delivered.

It will be apparent to one skilled in the art that under certain circumstances it will be advisable to incorporate an audible warning device in addition to or in place of the visual warning device 64 in order to provide a supplemental sensory announcement that the mail has been delivered.

Figure 5:
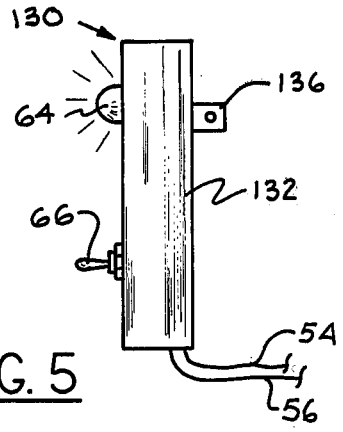
FIG. 5 illustrates yet another alternate embodiment of the display subsystem of the mailbox alarm system.

An alternate embodiment of the display subsystem is illustrated generally as 130 in FIG. 5. The alternate embodiment includes a generally rectangular box 132 having the signal light 64 and disable switch 66 coupled to a front surface thereof. A male plug 136 is provided for directly coupling into the normally 110 volt 60 cycle wall receptacle. The male plug 136 is coupled to the primary of the transformer 70 so that the alternate embodiment of the display subsystem 130 is physically supported by the same wall receptacle which provides electrical energy to power the alarm/signaling system.

It is also envisioned that a low frequency signal generator could be coupled to the secondary windings of the transformer 70 in order to be actuated responsive to the closing of the switch 50. In this manner the low frequency signal will be coupled through the transformer 70 and into the conductors comprising the electrical service for the entire house or business. A remote sensing unit similar in appearance to the display subsystem 130 could then be coupled randomly about the house or business in order to receive the radio frequency signal and responsive thereto actuate the signal light 64. In this manner the remote display could be carried from room to room throughout the house or business without the necessity of disconnecting and then reconnecting the original cables 54 and 56 coupled to the switch 50. This remote transmission subsystem also has the advantage that no additional breaches are required in the structure since the transmission or outside unit could be coupled to an outside electrical box and then the receiving subsystem could be coupled to an inside wall receptacle. While this radio frequency carrier signaling scheme introduces somewhat more complexity in the circuitry involved, it is well within the state of the art and provides a significant increase in the flexability of the system as it is commonly utilized.

Figure 2:
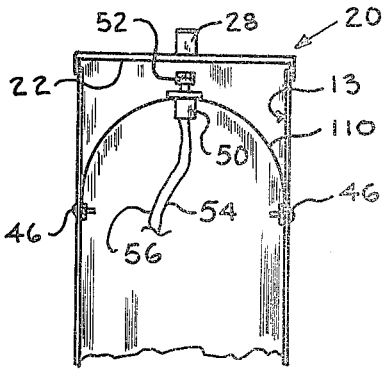
FIG. 2 illustrates a second preferred embodiment of a bracket for placing the alarm sensor switch adjacent to the lower tongue section of the mailbox door.

A second preferred embodiment of the mounting bracket is illustrated generally as 110 in FIG. 2. This second embodiment of the mounting bracket 110 can have either the U-shape as illustrated in FIG. 2 or the V-shape as illustrated in FIG. 1. However, the second embodiment of the mounting bracket 110 is manufactured of a material which will deform when pressure is placed upon the switch 50 by the tongue section 22 when the door 20 is opened. One of the problems with the first preferred embodiment as illustrated in FIG. 1 is that the relatively long travel of the lower section of the tongue 22 of the door 20 is typically incompatible with the relatively short linear displacement allowed by the typical switch 50. The advantage of the second preferred embodiment of the mounting bracket 110 is that once the button 52 on the electrical switch 50 has been completely depressed in order to actuate the switch 50, any additional pressure exerted by the operator in fully opening the door 20 is harmlessly transferred into a temporary deformation of the mounting bracket 110. When the door 20 is closed, the plastic or metal material of the mounting bracket will spring back into its original shape, thereby returning the switch 50 to its original position adjacent to the tongue 22. It will be apparent to one skilled in the art that various other forms of deformable mounting brackets 110 may be substituted for the form as illustrated in FIG. 2 without departing from the concept of utilizing a short travel inexpensive switch 50 in an application which requires a switch having a relatively long travel before the switch is actuated.

Figure 3:
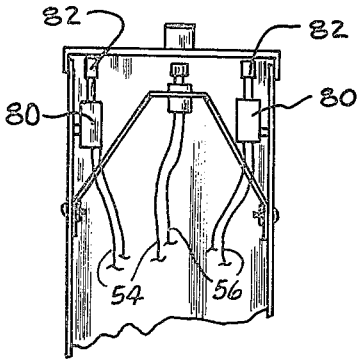
FIG. 3 illustrates another alternate embodiment of the present invention which uses electro-mechanical solenoids for locking the mailbox door in a closed position.

A third embodiment of the present invention is illustrated generally in FIG. 3. The third embodiment is typically the same as either the first or second embodiments as illustrated in FIGS. 1 or 2, with the exception that one or more solenoids are electrically coupled with the circuit conductors 54 and 56. These solenoids 80 include extendable head section 82. When the solenoid 80 is de-energized, the heads 82 will project outwardly from the body of the solenoid 80 in order to lock and positively communicate with the tongue section 22 of the door 20. In this manner the resistive force provided by the solenoids 80 and the heads 82 will prevent any unauthorized entry through the door 20.

It is envisioned that a latching type solenoid 80 would be preferable in this application such that once electrical energy is removed from the solenoid 80 and the head section is extended the requirement of continuous power for the solenoid 80 will be eliminated. It is also envisioned that the latching solenoid 80 would unlatch as soon as the disable switch 66 was opened in order to interrupt the flow of electrical current to the solenoid 80 and thus extend the head sections thereof. While FIG. 3 illustrates two of the solenoids 80, it will be apparent to one skilled in the art that only one solenoid 80 will be suitable, and in fact the single solenoid 80 could be used to operate a mechanical equivalent of two extendable heads 82.

Prior to the delivery of the mail, the solenoid 80 is energized so that the head section 82 is withdrawn into the body of the solenoid 80. The head sections 82 are therefore not in contact with the tongue section 22 of the cover 20, thereby allowing the door 20 of the mailbox 10 to open freely. When the mailman is ready to deliver the mail, he opens the door 20 which in turn actuates the switch 50 breaking the circuit and thus allowing the spring action solenoid 80 to extend the head section 82 thereof into contact with the tongue section 22 of the door 20. The force of the solenoid 80 acting against the tongue section 22 of the door 20 is sufficient to close the door 20 when it is not being held, but this force is not sufficient to cause the door to close when being held open by the mailman. As previously discussed, the snap action solenoids will positively lock into place when the door is completely closed, thereby locking the door into a closed position. In this condition no electrical power will be required to maintain the locking condition of the solenoid 80.

In order to open the box, the owner/operator would energize the solenoids 80 by actuating the switch 50. This circuit design has the additional advantage in that if an unauthorized person severs the wires 54 or 56 at the mailbox, electrical energy would be removed from the solenoids 80 thereby causing them to extend and lock into position for securing the mailbox against theft.

The embodiments of the present invention as illustrated in FIGS. 1, 2 and 3 have been shown with the mounting brackets 42 and 110 exposed, but it will be apparent that it may be advisable to provide a cover over part of or the entire base 12 in order to enclose this area. While this cover would substantially increase the cost of manufacturing the present device, the increased cost may be more than off-set by the additional security and reliability provided by shielding the switch 50 from outside elements and tampering.

Figure 4:
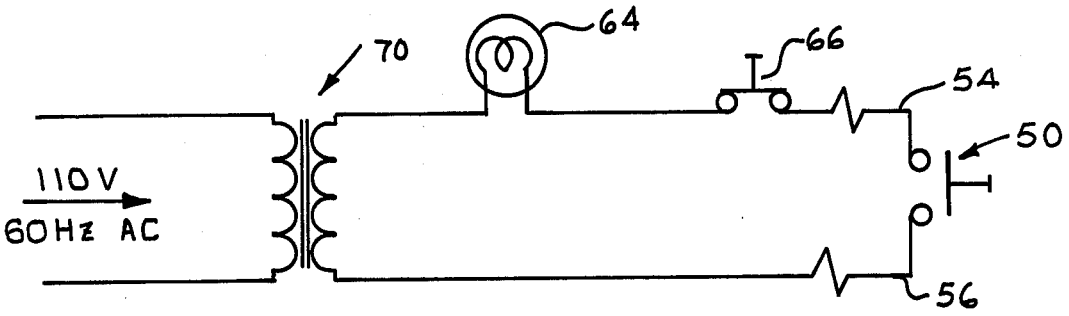
FIG. 4 illustrates a simplified electrical schematic diagram of the present invention.

It will also be obvious to one skilled in this art that whereas the schematic diagram of FIG. 4 illustrates the use of 110–220 volt 50–60 Hertz AC voltage for operating the present device, it may be possible and in some situations preferable to use a battery rather than the household power.

It will also be obvious to one skilled in this art that whereas the present form of the schematic illustrated in FIG. 4 utilizes wire conductors 54 and 56 to couple the switch 50 to the signaling device 64, it may be preferable to utilize a radio frequency transmitter for this purpose. Thus, the switch 50 would enable the radio transmitter to transmit the required signal which would then be received by a remotely located radio frequency receiver which in turn would then illuminate the light 64 in order to indicate that the door 20 of the mailbox 10 had been opened. While this alternate embodiment would substantially increase the cost of production of the mailbox alarm, this form of the invention may be required in cases where it is difficult or impossible to lay the wires 54 and 56 between the location of the mailbox 10 and the location of the display system 60.

Thus, several preferred embodiments of the mailbox alarm system have been described as examples of the invention as claimed. However, the present invention should not be limited in its application to the details illustrated in the accompanying drawings and the specification, since this invention may be practiced and constructed in a variety of different embodiments. Also, it must be understood that the terminology and descriptions employed herein are used solely for the purpose of describing the general operation of the preferred embodiment and the method disclosed herein, and therefore should not be construed as limitations on the operability or construction of the invention.

We claim:

1. A signaling device for being coupled to a mailbox of a type including a generally horizontal base and an upward extending container coupled thereto for defining an entryway and a storage compartment therein, a door for closing over the entryway, a hinge coupled between the base and a section of the door above a lower edge thereof so as to define a lower cantilevered tongue section of the door which rotates toward the base as the door is opened, said signaling device comprising in combination:

switch means mounted adjacent a lower surface of the base and adjacent to the tongue section of the door for generating a first signal responsive to operative communication with the tongue section of the door as the door is opened;

a U-shaped bracket having said switch means coupled to a central deformable section thereof and further having distended ends thereof coupled to the base for support, said central deformable section of said U-shaped bracket being flexible in order to deform responsive to an additional opening displacement of the door beyond that displacement necessary in order to actuate said switch means, whereby said switch means may be located immediately adjacent to the tongue section of the door for sensing small displacements thereof without being damaged by unexpectedly large displacements of the door; and electrical signal means coupled to said switch means for generating a sensory perceptible signal responsive to receiving said first signal.

2. The signalling device as described in claim 1 wherein said switch means comprises a longitudinally movable snap-action switch which locks into a closed condition upon being first depressed, and which must be released and again depressed in order to revert to an open condition.

3. The signaling device as described in claim 1 wherein said U-shaped bracket is located within a generally rectangular recessed area beneath the base as defined by the base and the container.

4. The signaling device as described in claim 1 wherein said electrical signal means further includes disable switching means for disabling said sensory perceptible signal.

5. The signaling device as described in claim 1 further including first and second circuit means operatively interposed between said switch means and said electrical signal means for transmitting said first signal therebetween, with said first circuit means being inductively coupled between said switch means and one section of the household electrical service, and with said second circuit means being inductively coupled between a second section of household electrical service and said electrical signal means, whereby said first signal is transmitted over the same existing household electrical system conductors which supplies power thereto.

6. The signaling device as described in claim 5 wherein said electrical signal means comprises a light bulb electrically coupled to a transformer and each mechanically attached to a signal box, with the primary leads of said transformer extending from said signal box in the form of a male connector of the type for coupling with a standard electrical wall receptable, said transformer being powered and supported by said male connector coupled into the standard electrical wall receptable.

7. The signalling device as described in claim 1 further including at least one electrical solenoid coupled to the base adjacent to the tongue section of the door, with said solenoid for extending into communication with the tongue section of the door for limiting the opening movement of the door responsive to said solenoid receiving said first signal from said first means.

8. The signalling device as described in claim 7 wherein said solenoid electrically moves into and out of an extended position and wherein said solenoid further includes mechanical latching means controlled by said first signal for locking said solenoid into said extended position.

* * * * *